United States Patent [19]

Adair

[11] Patent Number: 4,489,837

[45] Date of Patent: Dec. 25, 1984

[54] MECHANIC'S CREEPER SUPPORT AND UTILITY TRAY

[76] Inventor: G. Brison Adair, 9401 Fairleigh Ct., Burke, Va. 22015

[21] Appl. No.: 387,794

[22] Filed: Jun. 14, 1982

[51] Int. Cl.[3] ..... A47F 5/00

[52] U.S. Cl. ..... 211/86; 211/87; 211/88; 211/13

[58] Field of Search ..... 211/86, 87, 88, 59.1, 211/13, 17; 248/307

[56] References Cited

U.S. PATENT DOCUMENTS

| | | | |
|---|---|---|---|
| D. 135,982 | 7/1943 | Morris | 211/13 X |
| 275,481 | 4/1883 | Gould | 211/87 X |
| 1,970,576 | 8/1934 | Replogle et al. | 211/13 X |
| 2,019,826 | 11/1935 | McKee | 211/87 X |
| 2,901,303 | 8/1959 | Anderson | 211/86 X |
| 3,239,272 | 3/1966 | Wilkins | 211/88 X |
| 3,411,633 | 11/1968 | Magnuson | 211/13 |
| 3,895,605 | 7/1975 | Goldman | 211/88 X |
| 3,986,649 | 10/1976 | Heimstra | 211/88 |

FOREIGN PATENT DOCUMENTS

| | | | |
|---|---|---|---|
| 1433541 | 2/1966 | France | 211/88 |
| 286703 | 3/1953 | Switzerland | 211/13 |
| 4581 | of 1914 | United Kingdom | 211/88 |
| 417869 | 11/1934 | United Kingdom | 211/86 |

*Primary Examiner*—Ramon S. Britts
*Assistant Examiner*—Blair M. Johnson
*Attorney, Agent, or Firm*—Dennis L. Kreps

[57] ABSTRACT

An accessory support is provided for attachment to a mechanic's tool cabinet for storage of a mechanic's creeper and other frequently used items, such as aerosol cans. The support base is in the form of an elongated storage tray, sized for attachment to the end of most standard tool cabinets or side boxes. Two outwardly and upwardly extending arms, adjustably mounted on the outer side of the support tray, are provided to support the caster shafts of a mechanic's creeper. A third support arm extends downwardly from the outer side of the base in the form of a hook for storing a coiled air hose or the like, and also serves to stabilize the supporting platform of the creeper, to maintain it stationary in a vertical position.

3 Claims, 7 Drawing Figures

MECHANIC'S CREEPER SUPPORT AND UTILITY TRAY

BAACKGROUND OF THE INVENTION

Automotive mechanics find themselves in an enviable position these days. With the cost of new automobiles increasing at an alarming rate, more and more people are keeping cars longer than they have in the past, and thus the older cars require more frequent maintenance, not only to meet periodic vehicle inspections and emission tests, but also for peace of mind for the owners of these older cars. Thus, automotive mechanics are kept quite busy in these times, and anything which aids a mechanic in the swift and efficient performance of his duties is desirable.

In many repair ships, a mechanic keeps his tools in a portable tool cabinet. The cabinet is on wheels, for ease of mobility, and includes a set of drawers therein for storage of larger tools. The usual toolbox for smaller tools rests on top of the cabinet, and an auxiliary side box may also be attached to the main cabinet according to the mechanic's needs. Wheels on the main cabinet allow the mechanic's entire set of tools to be rolled from one service bay to another, or up and down the length of the vehicle being serviced, in order to keep the tools available near that portion of the vehicle being repaired.

However, some items, such as creepers and air hoses for pneumatic tools, are too large or cumbersome to be placed in a tool cabinet drawer or toolbox. These are usually stored on the side or back wall of the garage, and may be some distance from a machanic's work area, thus complicating a mechanic's working procedures, and consuming valuable time when such items are needed.

SUMMARY OF THE INVENTION

The present invention relates to an accessory support means which may be readily attached to any standard mechanic's tool cabinet or side box to provide convenient storage of large or cumbersome items, specifically a mechanic's creeper, in such a manner that said items will be maintained readily available along with the mechanic's other tools, even when the tool cabinet is mounted on wheels for portability around a service bay or repair shop.

An elongated support tray is provided with a rolled edge along one of the long sides, which forms a hook to attach the tray to the upstanding edge of a standard tool cabinet or side box. Fastened to the remaining long side of the tray are two upstanding arms, adjustably attached thereto, and notched at their upper ends to receive the caster wheel axles of a mechanic's creeper.

Depending from the same tray side as the upstanding arms is an auxiliary support hook, which serves to stablize the mechanic's creeper in its vertical position, and from which may be hung a coiled air hose, drop light cord or the like.

DETAILED DESCRIPTION OF THE INVENTION

Figure 1:
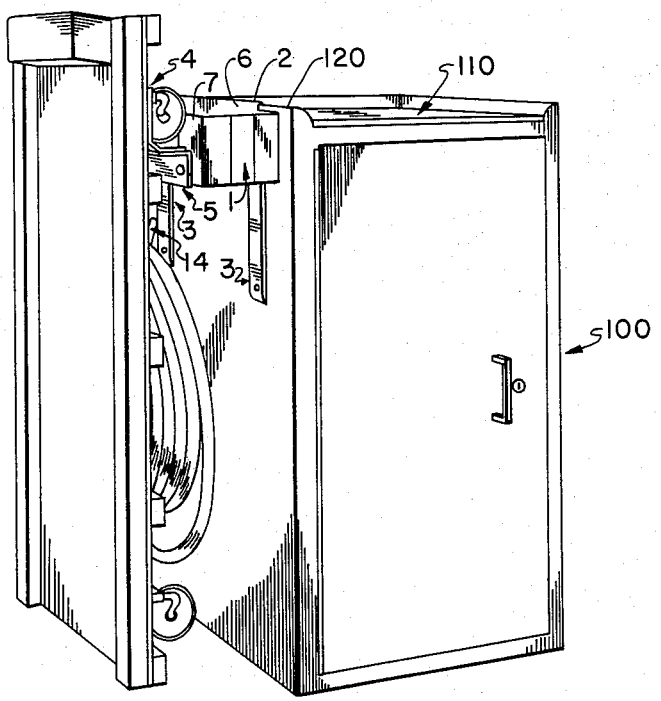
FIG. 1 is a perspective view of the apparatus of the invention in use.

Referring now to the drawings, in FIG. 1, the creeper support and utility tray of the instant invention is shown installed on a standard mechanic's portable tool cabinet 100. Such cabinets and side boxes commonly attached thereto have a large flat top 110 which may serve as a small workbench, or a support for a smaller toolbox, said top including an upstanding edge 120 on at least three sides thereof to keep smaller parts from rolling off the top and onto the garage floor.

Elongated support tray 1, desirably formed of a heavy gauge sheet metal, includes long sides 6 and 7. Side 6 includes a central portion 2, extending above the remaining three sides of support tray 1, which is rolled into the form of a hook to engage upstanding edge 120 at one end of the tool cabinet or side box 100.

Figure 7:
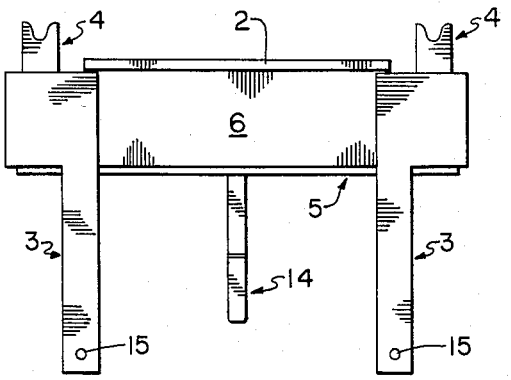
FIG. 7 is a rear view in elevation of the invention.

To provide further rigidity to this suspended support arrangement, two downwardly directed straps 3, best seen in FIG. 7, are attached to side 6 of support tray 1, one near each corner. The straps 3 are L-shaped, with the short arm of each L providing substantial reinforcement for the corners of support tray 1. The downwardly directed longer arms of the L are indented from the corners of support tray 1 to facilitate application of the invention to a wider range of tool cabinet or side box widths. For added security, holes 15 are provided in the lower ends of straps 3 to allow the straps to be secured directly to the side of tool cabinet 100 if desired.

In order to provide an adjustable attachment means for the two creeper support arms 4, a section of angle iron 5, coextensive with the outer long side 7 of support tray 1, is fastened thereto. A pair of adjustment slots 8 and 9 are cut into each end of the horizontal portion of angle iron 5. These allow adjustability of the distance between the two support arms, to accommodate variations in the distance between the axles of a standard creeper. Slots 8 adjacent support tray side 7 serve to locate guide tabs 10 of support arms 4, to facilitate their proper positioning, while the larger slots 9 retain bolts 11 and nuts 12 which rigidly maintain support arms 4 in the positions required for a particular creeper size.

Figure 2:
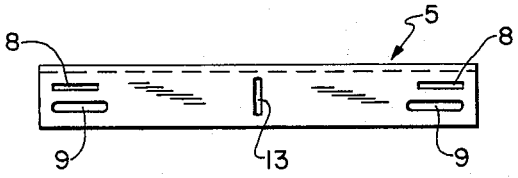
FIGS. 2, 3 and 4 show views of three of the individual pieces of said apparatus for detail; these pieces are angle iron 5, support hook 14, and creeper support arms 4, respectively.
Figure 3:
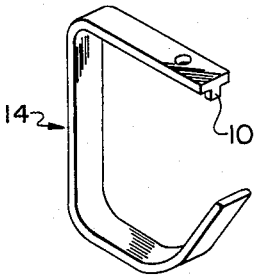
Figure 4:
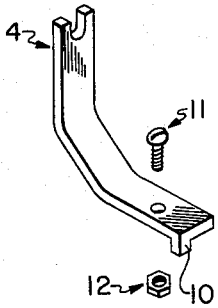
Figure 5:
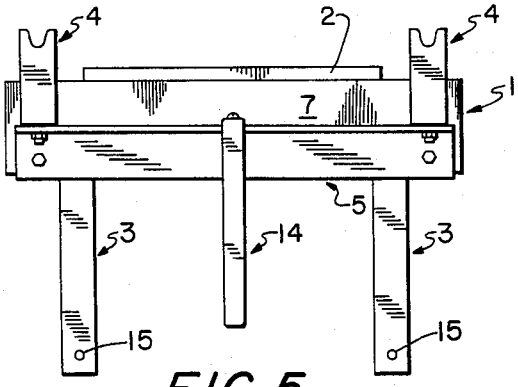
FIG. 5 is a front view in elevation of the invention.
Figure 6:
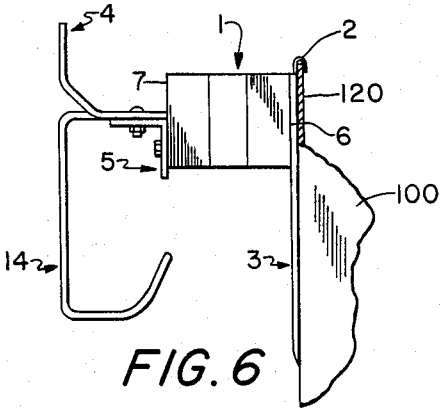
FIG. 6 is a side view in elevation of the invention.

Referring to FIG. 2, an additional slot 13 is cut at the center of angle iron 5, perpendicular to slots 8 and 9, to provide a mounting position for downwardly depending support hook 14. Slot 13 serves to locate both guide tab 10 and the nut and bolt which secure support hook 14 to angle iron 5. Storage of a coiled air hose, drop light or the like is merely an ancillary feature of support hook 14. Its main purpose, and the reason for the adjustability provided by slot 13, is to allow it to be placed adjacent the bottom side of the mechanic's creeper when it is hung by its caster axles on support arms 4 to stablize the creeper in a vertical position, thus precluding its swinging to-and-fro.

While the description of the creeper support and utility tray herein disclosed constitutes a preferred embodiment of the invention, it is to be understood that the invention is not limited to this particular embodiment, and that changes may be made therein without departing from the scope of the invention as defined in the appended claims.

I claim:

1. An accessory support assembly for a tool cabinet, which is comprised of:

a support tray base and four upwardly depending side members forming an open-topped rectangular container structure, with one of the longer side members being attached to one end of said tool cabinet;

a pair of support straps depending downwardly from said longer side member attached to said tool cabinet, one adjacent each of the shorter side members depending upwardly from said support tray base, for engaging the side of said tool cabinet for stability; and a pair of support arms attached to the outer longer side of said support tray base opposite the side attached to said tool cabinet, extending outwardly therefrom, said arms being notched at their upper ends for receiving the caster axles of a mechanic's creeper.

2. An accessory support assembly in accordance with claim 1, in which said support arms are adjustably attached to said outer wall of said support tray base to allow adjustment of said arms to accommodate creepers of varying dimensions.

3. An accessory support assembly in accordance with claim 1, in which an auxiliary hook support member depends downwardly from the outer longer side of said support tray base, with the vertical plane formed by the longitudinal axis of said auxiliary hook support member being situated between the vertical planes formed by the longitudinal axis of said auxiliary hook support member being situated between the vertical planes formed by the longitudinal axes of said support arms, which auxiliary hook support member is adjustable against the bottom portion of said creeper to stabilize said creeper in its vertical storage position.

* * * * *